US005083429A

United States Patent [19]

Veres et al.

[11] Patent Number: 5,083,429

[45] Date of Patent: Jan. 28, 1992

[54] METHOD OF AND COMPRESSION TUBE FOR INCREASING PRESSURE OF A FLOWING GASEOUS MEDIUM, AND POWER MACHINE APPLYING THE COMPRESSION TUBE

[76] Inventors: Gergely Veres, Bog/e,acu/a/ r u. 29/D, Budapest; László Lengyel, Istenhegyi út 50/C, H-1125 Budapest, both of Hungary

[21] Appl. No.: 373,987

[22] Filed: Jun. 29, 1989

[30] Foreign Application Priority Data

Jul. 8, 1988 [HU] Hungary ..... 3591/88

[51] Int. Cl.[5] ..... F01D 31/00

[52] U.S. Cl. ..... 60/325; 60/269; 239/128

[58] Field of Search ..... 239/128, 553.5, 590.5; 60/269, 270.1, 325

[56] References Cited

U.S. PATENT DOCUMENTS

| | | | |
|---|---|---|---|
| 3,690,102 | 9/1972 | DuPont | 60/269 |
| 3,800,531 | 4/1974 | Sharpe | 60/269 X |
| 4,224,790 | 9/1980 | Christensen | 60/269 X |

FOREIGN PATENT DOCUMENTS

| | | |
|---|---|---|
| 648878 | 1/1934 | Fed. Rep. of Germany . |
| 935449 | 10/1955 | Fed. Rep. of Germany . |
| 1095598 | 12/1960 | Fed. Rep. of Germany . |
| 1503697 | 2/1970 | Fed. Rep. of Germany . |
| 2109051 | 5/1972 | France . |
| 2122264 | 1/1984 | United Kingdom . |
| 2170324 | 7/1986 | United Kingdom . |

OTHER PUBLICATIONS

Kentfield: "Methods For Achieving A Combustion--Driven Pressure Gain In Gas Turbines" *Transaction of the ASME*, 110: 704–11, Oct. 1988.

Abdulhadi, M.: "Dynamics of compressible air flow with friction in a variable-area duct" in *Warme und Stoffunbertragung* 22: 169–172 (1988).

Shapiro, A. M.: *The Dynamics and Thermodynamics of Compressible Fluid Flow* Roland Press: New York, N.Y. 1953, Chapter 8.

*Primary Examiner*—Edward K. Look
*Assistant Examiner*—Thomas Denion
*Attorney, Agent, or Firm*—Schweitzer Cornman & Gross

[57] ABSTRACT

In a method of and a compression tube (10) for increasing pressure of a flowing gaseous medium the gaseous medium is pressed by an accelerating element (8) to flow with supersonic velocity. Heat is abstracted from the gaseous medium having supersonic velocity and by shock waves the flow is decelerated to a subsonic velocity range in an impact tube section (13) wherein by decelerating and, if necessary, further abstracting heat the pressure is increased. The power machine comprises in any pipeline section and/or instead of compressor a compression tube (10) including the accelerating element (8), a transient tube section (14) receiving supersonic flow of the gaseous medium, an impact tube section (13) comprising a shock wave tube section (12) and advantageously a passage tube section (16) for decelerating the supersonic flow to subsonic velocity and increasing the pressure to a value exceeding the inlet pressure of the accelerating element (8).

36 Claims, 1 Drawing Sheet

METHOD OF AND COMPRESSION TUBE FOR INCREASING PRESSURE OF A FLOWING GASEOUS MEDIUM, AND POWER MACHINE APPLYING THE COMPRESSION TUBE

BACKGROUND OF THE INVENTION

The present invention refers to a method of and a compression tube for increasing pressure of a flowing gaseous medium, further to a power machine applying the proposed compression tube. According to the art the method of the invention comprises the steps of accelerating flow of a gaseous medium to a supersonic velocity, impacting the supersonic flow of the gaseous medium into a space including shock waves and decelerating thereby the supersonic flow of the gaseous medium to a subsonic velocity range. The compression tube consists of tube sections arranged along the path of flow of the gaseous medium in a linear system, wherein the first of the tube sections is an accelerating element, then a transient tube section and outlet means follow. The power machine as proposed includes an inlet section for inducing flow of a gaseous medium, a compressor for increasing pressure of the gaseous medium, power transformation means for producing mechanical work on the basis of the gaseous medium received and exhaust means for expelling remainings of the gaseous medium, wherein the an inlet section, compressor, power transformation means and exhaust means form a linear arrangement, they are divided and connected in the linear arrangement by respective pipeline sections.

The increase of the pressure (the compression) of the gaseous media is generally intended to ensure continuous volume or mass transfer, because of the possibility of ensuring the volume or mass transfer (an "extensive" variable of the thermodynamic process) by means of an appropriate pressure gradient (an "intensive" variable of the thermodynamic process).

In order to increase the pressure of a gaseous medium it is always necessary to assure energy transport, i.e. to produce work. Thus, the compression process can be completed by mechanical, thermal and electromagnetic effects, however, other physical and chemical processes are also applicable for this purpose.

The present invention proposes the compression process to be completed by the use of aerodynamic forces. In this case there is a continuous path within the space of flowing the gaseous medium, there is no separation between the high and low pressure space parts. The pressure difference between two points of the aerodynamic arrangement is maintained by changing the impulse per unit of the volume in the flow of the gaseous medium. The energy transfer required in this process can be expressed by the means of the enthalpy of the gas. The general theory of the aerodynamic machines of this kind is the subject of the book of Shapiro, A. M.: The Dynamics and Thermodynamics of Compressible Fluid Flow (Roland Press, New York, 1953, chapter 8, especially pages 228 to 231). The special problems arising with application of the supersonic flow of a gaseous medium are the subject of the article of Abdulhadi, M. (Dynamics of Compressible Air Flow with Friction in a Variable-area Duct, Wärme- und Stoffübertragung, 22, 1988, pages 169 to 172).

A control device for a pumping system incorporating fluidic devices is shown in the GB patent application No. 2 170 324 filed in January 1985 (in the name of British Nuclear Fuels plc). The fluidic device being the merit of this application has an air inlet leading to a convergent/divergent nozzle, particularly a Laval nozzle producing supersonic velocity flow. A compressive shock wave is produced just upstream of an intake of a diffuser applied for decelerating the flow of the air. This device can be used in a pumping system, e.g. in a system incorporating a reverse flow diverter.

The geometric arrangement of the device described in the GB-A 2 170 324 mentioned above is very advantageous for increasing pressure during the operation of a pumping system. The shock waves produced by means of an intake (e.g. an Oswatitsch intake or other) consume relatively high amounts of energy, and thus the enthropy increase of the flow is disadvantageous. This device discloses the possibility of practical application of supersonic velocity flow for increasing pressure of a fluid medium. However, the application is limited to fluidic pumps.

In different technical fields the injectors (and ejectors) are widely used when increased pressure of a gaseous or liquid medium flowing in a tube is required. The injectors and ejectors are very simple, but they show low efficiency. They comprise a nozzle for accelerating the flow of a gaseous or liquid medium, a transient tube section and outlet means. The increased pressure results from the application of a diffuser in the outlet means.

The efficiency of the power machines, and especially of the gas turbines can be improved by applying combustors and other means for generating a stagnation-pressure increase, instead of the customary loss of stagnation pressure that occurs with conventional steady flow combustors (as stated e.g. in the article of Kentfield, J. A. C. and O'Blenes, M. (Methods for Achieving a Combustion-Driven Pressure Gain in Gas Turbines, Transaction of the ASME, vol. 110, 1988, October, pages 704 to 710). The recognition of the authors described in this article refers only to the combustion process realised in the gas turbines.

SUMMARY OF THE INVENTION

The object of the present invention is to provide a method of manipulating with a gaseous medium flowing in a tube and a compression tube for increasing the pressure of a flowing gaseous medium. A further object of the invention is to provide an improved power machine making use of the proposed novel method and compression tube.

The invention is based on the recognition that the pressure of a flowing gaseous medium can be increased by heat manipulation carried out in the direction of the flow of the medium for increasing the stagnation pressure of the gaseous medium flowing in a continuous stream or in discrete stream parts. (The stagnation pressure means the pressure belonging to a state of the gaseous medium that can be ensured by an isenthropic process starting from another state of the gaseous medium if the velocity of the flow equals to zero.)

The basic problem of the present invention is that the actual pressure of a flowing gaseous medium can be modified in a simple way, e.g. by altering the cross-section area of the duct receiving the flow, in contrast to the stagnation pressure which is difficult to increase. The present invention proposes a simple solution to this problem, offering a simple method of and an advantageous compression tube construction for increasing the stagnation and the actual pressure of a gaseous medium.

The present invention discloses a method of and a compression tube for increasing pressure of a flowing gaseous medium, especially for use in power machines. It discloses also a novel power machine making use of the method and compression tube proposed.

The method of the invention comprises the steps of accelerating flow of a gaseous medium to a supersonic velocity range, impacting the supersonic flow of the gaseous medium into a space including shock waves generated by the means of the output pressure of the process and decelerating thereby the supersonic flow of the gaseous medium to a subsonic velocity range and, if necessary, conducting the gaseous medium of subsonic velocity through a passage tube section for further increase of the pressure and diminishing the subsonic velocity, wherein the most important novel step is that of abstracting heat from the gaseous medium during its flow with supersonic velocity, i.e. after accelerating, advantageously during conducting this flow through a supersonic diffuser.

The supersonic range means generally the range defined by a Mach number between 1.2 and 1.5.

If the accelerating process requires relatively long tube section, it is advantageous to create adiabatic conditions during the accelerating step, e.g. by applying a thermoisolating mantle around the means of accelerating, the accelerating means being generally consisted of a nozzle, e.g. a Laval nozzle.

It is also advantageous to abstract heat from the gaseous medium during its flow with subsonic velocity in the passage tube section and to heat up the gaseous medium leaving the passage tube section to a predetermined value, if necessary. The temperature of the gaseous medium may be increased by heating up e.g. to the value characterizing the medium before entering the accelerating step. During this heating step it is advantageous to apply isobaric conditions, i.e. to ensure constant pressure.

For abstracting heat it is possible to apply physical and chemical measures, e.g. cooling the surface of a tube section wherein the abstracting step is carried out or to inject a liquid or gaseous substance into the flow of the gaseous medium, the substance subjectable to vaporizing or dissociating by physical and chemical processes and/or to other physical and/or chemical reaction requiring heat abstracting.

The gaseous medium subjected to increasing the pressure can be a medium consisting of free charge ions, i.e. an electrically conductive fluid medium moving in an appropriate magnetic field in order to realize increase of the pressure in a magnetohydrodynamic process. In this case the Maxwell's equations of the electromagnetic field and the Navier-Stokes' equations of the hydrodynamics should be taken into account when designing the process of increasing the pressure of a magnetohydrodynamically active gaseous medium during flow.

The compression tube of the invention comprises in a linear arrangement along a path of flow of a gaseous medium an accelerating element, particularly a nozzle, a transient tube section, communicating with the outlet of the accelerating element and outlet means. If necessary, means are provided for generating a magnetic field influencing in a mutual coupling process the flow of an electrically conductive fluid medium. The accelerating element applied, e.g. a Laval nozzle, is capable of increasing the velocity of flow of the gaseous medium to a supersonic range. The transient tube section is capable of abstracting heat from the flowing gaseous medium; preferably it is shaped as a supersonic diffuser. The outlet means comprises an impact tube section for receiving a shock wave region for decelerating the flow of supersonic velocity to a subsonic velocity, wherein further the shock wave region depends on the outlet pressure of the outlet means connected with the outlet of the transient tube section. The impact tube section may comprise also a passage tube section following a shock wave tube section, the passage tube section forming advantageously a subsonic diffuser tube element.

It is also advantageous to apply an outlet tube section connected with the outlet of the impact tube section, the outlet tube section being, if necessary, connected with an outer heat source.

An outer heat source can be connected also with a tube section arranged before the inlet of the accelerating element, for heating up the gaseous medium entering the accelerating element.

A further advantageous embodiment of the compression tube of the invention is equipped with injecting means, especially an injecting jet arranged in space connection with, particularly having outlet in the inlet plane of the accelerating element for introducing into the flow of the gaseous medium a fluid substance, particularly water or a substance vaporizable or dissociating in the conditions of the flow of the gaseous medium.

The invention proposes further a power machine, comprising an inlet section for inducing flow of a gaseous medium, a compressor for increasing pressure of the gaseous medium, power transformation means for producing mechanical work on receiving the gaseous medium and exhaust means for expelling remainings of the gaseous medium. The inlet section, compressor, power transformation means and exhaust means are independent and are connected by respective pipeline sections. The novel feature lies in substituting the compressor and/or partly or fully one or more pipeline sections, and especially the pipeline section connecting the power transformation means and the exhaust means, by a compression tube as described above. It is especially advantageous to apply the proposed compression tube at the outlet of the power transformation means, for generating a relatively great pressure difference between the output of the power transformation means and the input of the exhaust means by inserting the compression tube proposed according to the invention.

The proposed method realises the steps for increasing pressure in a very simple way. The simplicity is also the main advantage of the proposed compression tube, which can improve also the efficiency of the work processes of the power machines, and especially the conditions of work of a gas turbine, turbocharge means of an engine to be applied in a car etc.

BRIEF DESCRIPTION OF THE DRAWINGS

The invention will be described further in more detail by way of example and with reference to preferred realizations and embodiments illustrated in the accompanying drawings, wherein.

DESCRIPTION OF THE PREFERRED EMBODIMENTS

Figure 1:
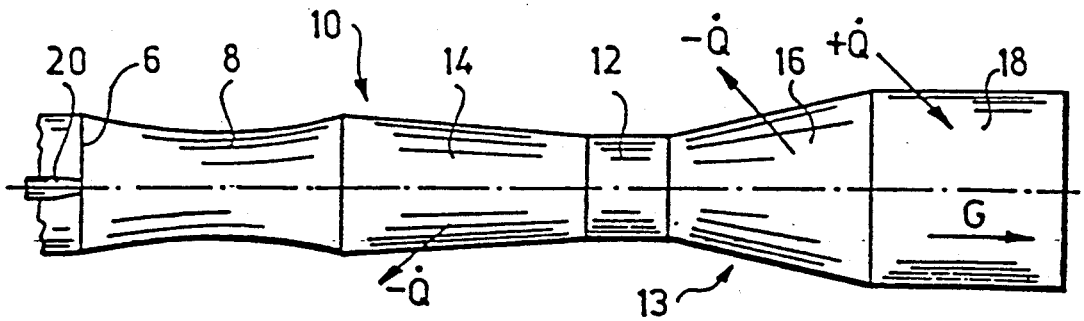
FIG. 1 is a longitudinal cross-section of a compression tube proposed by the invention.

In the method of the invention a gaseous medium flowing in direction denoted by arrow G from a tube section arranged before the inlet of an inlet element is provided in order to increase the pressure. The inlet element of the method is capable of accelerating the flow of the gaseous medium to a supersonic velocity, especially to a velocity determined by the Mach number in the range 1.2 to 1.5. Generally the higher Mach numbers may be disadvantageous because of intensifying the inner friction losses with increasing Mach numbers.

The gaseous medium accelerated to a supersonic velocity flows further through a tube element, called in the present specification transient tube section, wherein heat can be and is abstracted from the gaseous medium, as represented by the arrow denoted with $-\bar{Q}$. This can be accomplished e.g. by heating the surface of the transient tube section, if the length of the tube section and the velocity of flow renders it possible to realise effective heat exchange in this way.

The heat abstracting step is carried out generally by injecting a fluid medium into the stream of the gaseous medium, the substance being subjectable to an endothermic physical or chemical process. Such process is e.g. that of vapourization or dissociation etc. The most effective solution is the application of water—the vapourization process requires a high amount of heat. Another possibility is to inject an appropriate dissociating gas, e.g. methane ($CH_3OH$) or ammonium ($NH_3$) decomposing and/or dissociating to different gaseous substances.

The environment of the heat abstracting step is generally a tube forming a supersonic diffuser, i.e. having cross-section area diminishing in direction G of the flow. This is very advantageous because of the inherent accelerating effect of the heat abstracting step to the gaseous medium flowing with supersonic velocity. In this way the supersonic velocity will not increase, it can be maintained in the required range.

After the heat abstracting step the gaseous medium reaches an impact tube section wherein shock waves are present. The shock waves are generated by the gaseous medium per se, when the supersonic stream of this gaseous medium falls into a region filled out with the same gaseous medium which stands or flows slowly. The length of the shock wave region, the intensity of the shock waves depend on the outlet pressure $P_{out}$ of the process applied for increasing the pressure. In this region the shock waves result in decelerating the stream of the gaseous medium to a subsonic velocity, i.e. to a velocity characterized by a Mach number with value not exceeding 1.

The deceleration process may be not effective enough to decrease the velocity of flow to a required range in order to increase the pressure. If this is the situation, a further heat abstracting step denoted by $-\bar{Q}$ follows in a subsonic diffuser. This results in reaching an outlet pressure $P_{out}$ exceeding the inlet pressure $P_{in}$ of the gaseous medium before accelerating.

The gaseous medium having the outlet pressure $P_{out}$ and leaving the subsonic diffuser can be heated up, if required, denoted by $+\bar{Q}$, for reaching a predetermined outlet temperature $T_{out}$ which may be equal to or differ from the inlet temperature $T_{in}$ of the gaseous medium before the beginning of the accelerating step. This heating up is generally accomplished in isobaric conditions.

Thus, the method of the invention is generally carried out by realizing the following steps:

A—expansion, advantageously in adiabatic conditions, e.g. by means of a Laval nozzle equipped, if necessary, with thermoisolation and ensuring thereby supersonic velocity of the flow of the gaseous medium;

B—abstracting heat from the gaseous medium flowing with supersonic velocity;

C—impacting the gaseous medium into a shock wave region comprising standing shock was generated by the means of compression and decelerating there-by the supersonic flow of the gaseous medium to a subsonic range; D—further diminishing the subsonic velocity and increasing thereby the pressure, especially in subsonic diffuser, E—increasing temperature of the gaseous medium, particularly by an isobaric process.

The five processes mentioned above do not form a thermodynamic cycle, because of the increased final pressure (outlet pressure) of the proposed method. The part processes meaning production of work for the environment can be, however, enclosed in a single cycle by the means of the isothermic, adiabatic or politropic expansion.

Figure 1A:
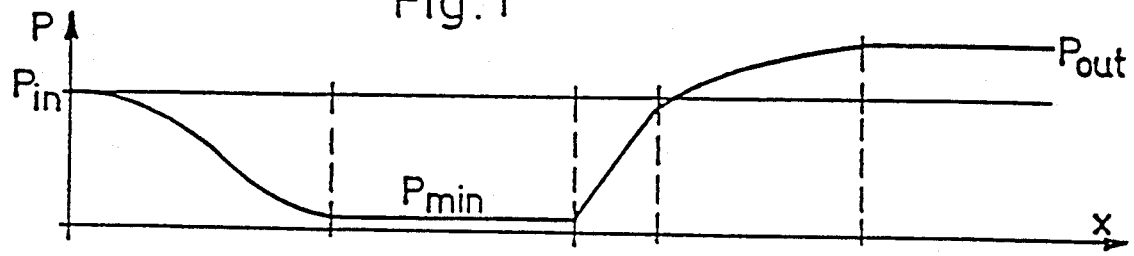
FIG. 1A shows the stagnation or total pressure versus length function of the compression tube represented in FIG. 1.
Figure 1B:
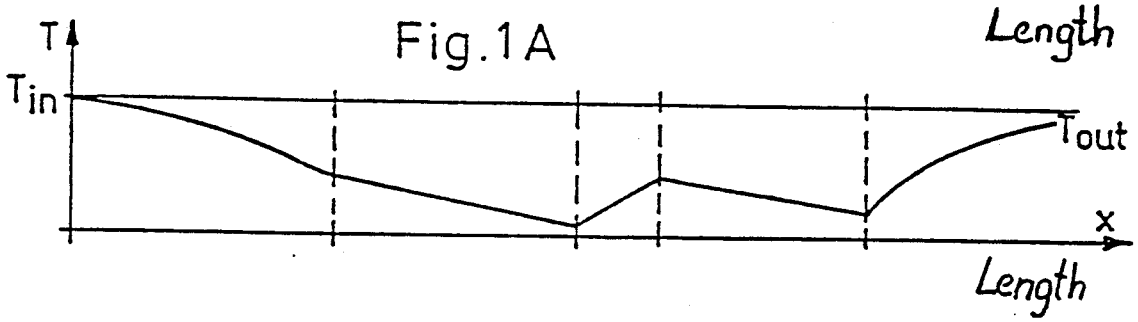
FIG. 1B shows the temperature versus length function of the compression tube represented in FIG. 1.

The method of the invention results in a pressure versus length and a temperature versus length function shown in FIGS. 1A and 1B. In the first three part processes both the temperature and the pressure are decreasing at the beginning and increasing later up to leaving the shock wave region. The supersonic diffuser, i.e. the heat abstracting step results in reaching a minimal pressure $P_{min}$ lying under the inlet pressure $P_{in}$. After leaving the shock wave region the temperature decreases and the pressure increases in the subsonic flow and during the last part process the temperature can be increased—the pressure remains in this part process constant.

In the process of the invention the inlet pressure $P_{in}$ can be increased in a gas turbine process from 70 $kN/m^2$ (70 kilonewton per $m^2$) to 100 $kN/m^2$. The temperature of the gaseous medium falls in this process from 500° C. to 150° C. before heating up.

The compression tube of the invention, denoted by 10 is shown in FIG. 1. The compression tube 10 consists of five tube elements connected to an inlet tube section not shown fully in this Figure. The outlet of the compression tube can be connected to exhaust means or other tube element, if necessary.

As it is clear from the FIG. 1, the input element of the compression tube 10 is an accelerating element 8 having an inlet plane 6. The accelerating element 8 is generally a Laval nozzle or other nozzle capable of accelerating to a supersonic velocity the flow of a gaseous medium introduced into the accelerating element 8 in the direction denoted by arrow G. The accelerating element is connected with a transient tube section 14, which is a straight tube or a supersonic diffuser with possibility of abstracting heat from the flow of the gaseous medium. The supersonic diffuser means an element having diminishing cross-section in the direction signed by the arrow G.

The outlet of the transient tube section 14, i.e. that of the supersonic diffuser is connected with an impact tube section 13 wherein standing shock waves are generated in the flow of the gaseous medium when the supersonic stream enters it. The standing shock waves can be generated, of course, by means of an intake, e.g. an Oswatitch intake as shown in the GB-PS 2 170 324 mentioned above, but this solution is not preferred because of high power losses caused by impacting on a solid element instead of a gaseous space. The intensity of the shock waves depends on the gaseous medium flowing, on the outlet pressure $P_{out}$ and on the dimensions of the impact tube section.

The impact tube section 13 is advantageously realised from two tube elements, wherein the first is a shock wave tube section 12 for receiving the supersonic flow of the gaseous medium and the shock waves generated thereby. The shock wave tube section 12 ensures deceleration of the supersonic flow to a subsonic velocity and thereby an increase of the pressure which falls in the transient tube section 14—because of abstracting heat—to a minimal value $P_{min}$. By the length of the shock wave tube section 12 it is per se possible to increase the pressure to a predetermined value, however, it is preferred to connect with the shock wave tube section 12 a passage tube section 16 being a straight line tube section or a subsonic diffuser (i.e. a tube element having cross-section area increasing with the direction of flow denoted by the arrow G). The passage tube section 16 is constructed so that it is possible to abstract heat from the flow of the gaseous medium.

The outlet of the passage tube section 16, i.e. the outlet of the impact tube section 13 is connected, if necessary, with an outlet tube section 18, wherein the gaseous medium can be heated up to a desired outlet temperature $T_{out}$.

As mentioned above with reference to the proposed method, the most important novel feature of the present invention lies in the heat abstracting step accomplished in the transient tube section 14 in any case, and, if required for further increasing the pressure, in the impact tube section 13, too, and especially in its passage tube section 16. The heat abstracting step requires either cooling the mantle of the respective tube section or introducing an appropriate cooling substance into the stream of the gaseous medium which is in most cases hot. Of course, the two measures cited above can be combined, i.e. taken also simultaneously. The most simple and effective solution is to inject water into the gaseous medium, e.g. through the mantle of the transient tube section or by applying injecting means 20 arranged in the longitudinal axis of the compression tube 10. The injecting means 20, generally an injecting jet, are arranged at the inlet plane 6 of the accelerating element 8 with outlet lying in or before the inlet plane 6.

The means for introducing the cooling substance are connected with the mantle of the corresponding tube sections or constituted by appropriate injecting jets arranged at the inlet of at least one section of the compression tube. Obviously, a combination of the two solutions can be applied, too.

In a realized embodiment of the compression tube proposed by the invention the 1/d (length per diameter) ratio of the main structural parts has the following values:

Structural part of the compression tube 10: 1/d, about
accelerating element 8: 1
transient tube section 14: 20
shock wave tube section 12: 1
passage tube section 16: 15

(The outlet tube section 18 plays no role in increasing the pressure of the gaseous medium.)

The values given above are examples only, and especially the passage tube section 16 can show a wide variation of the dimensions. The accelerating element 8 is also a Laval nozzle in the embodiment realized and the opening angle is about 4° at the inlet of the transient tube section 14.

It is to be noted that none of the FIGS. 1, 1A and 1B show the real dimensional proportions of the compression tube 10 and the real changes of the pressure and the temperature versus length of the compression tube 10. (the graphics shows only the characteristics of the changes in arbitrary units).

Figure 2:
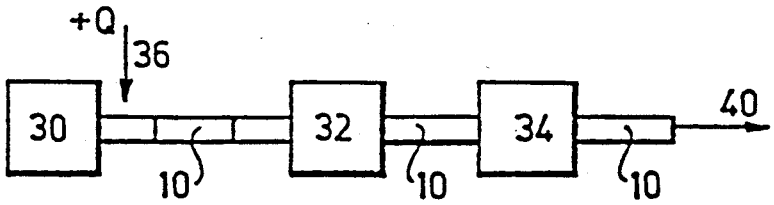
FIG. 2 is a schematic view of a power machine proposed by the present invention applying the novel compression tube of FIG. 1.

As shown in FIG. 2, a system of a power machine can be improved by application of the compression tube 10 proposed by the invention.

The system of the power machine to be improved according to the invention comprises an inlet section 30 for generating flow of a gaseous medium to be transported within the system. The output of the inlet section 30 is connected by a pipeline section with a compressor 32 for increasing the pressure of the gaseous medium. A further pipeline section connects the compressor 32 with the power transfromation means 34 for transforming one energy form into another, e.g. by combustion of the gaseous medium and driving thereby a gas turbine for producing mechanical work. The power transformation means 34 are connected with exhaust means 40 through a further pipeline section.

The essence of the invention is that any one of the pipeline sections defined above and/or the compressor 32 consists of or includes a compression tube 10. Of course, more pipeline sections can be completed and/or replaced by a compression tube 10.

According to the investigations it is the mostly preferred to apply the compression tube 10 on the output of the power transformation means 34, before the exhaust means 40. In this way the outlet pressure of the power transformation means 34 is lowered in comparison with the pressure of the exhaust means 40 which is generally equal to the ambient pressure. This improves the efficiency of the power transformation process for producing energy.

It is very advantageous to apply an outer source of heat energy for heating up the gaseous medium, before entering the accelerating element 8 and/or during its flow through the outlet tube section 18. This solution offers the possibility of making use of outer heat losses, the waste heat of other processes.

The compression tube 10 of the invention can be the basis of different advantageous power machine systems.

In th Joule cycle of a gas turbine system the compressor 32 is intended to produce appropriate inlet pressure for expansion. In the combustion chamber of the power transformation means 34 heat is introduced into the gaseous medium in order to assure the proper temperature for the expansion process. The temperature of combustion is too high, the gaseous medium leaving the combustion chamber should be cooled, e.g. by diluting in cool air. This temperature difference gives opportunity to increase pressure of the gaseous medium leaving the combustion chamber before entering the turbine. The compression tube 10 of the invention applied after the outlet of the combustion chamber can be operated with water instead of air for cooling the gaseous medium. Thus, no excess air to be compressed is necessary and the evaporated water on cooling the gaseous medium results in increasing stagnation pressure thereof. The calculations show that to produce a compression increase ratio 1/1.5 cooling by approximately 250° to 300° C. is needed wherein the temperature drop caused by the expansion in the accelerating element 8 is also taken into account.

This means, if the inlet temperature of the expansion turbine equals approximately 1000° C., then the temperature drop from the range 1300° to 1400° C. can result in pressure increase by about 50%, e.g. from 800 $kN/m^2$ to 1200 $kN/m^2$. By this solution about one third of the compression work required in the earlier solutions can be saved, i.e. a surplus power can be received on the shaft of the turbine.

The outlet temperature of a gas turbine lies generally in the range 400° to 500° C., depending mainly on the inlet pressure and the efficiency of the turbine. The outlet pressure is the ambient atmospheric pressure, i.e. it equals about 100 $kN/m^2$. By reducing the outlet pressure a surplus power can be generated due to the "longer" expansion process in the turbine. By inserting a compression tube 10 on the outlet of the turbine, before the exhaust means 40 the outlet pressure of the turbine can be lowered with the increase value assured by the compression tube 10. Suppose in a cooling process by about 300° C. it is possible to produce a pressure gain about 50% being as high as after the combustion chamber in the process depicted above. This means, the output pressure of the turbine can be as high as 70 $kN/m^2$ what results is a significant increase of the power on the shaft of the turbine without any essential modification of the energetic processes. The essence is that the physical heat of the exhaustion gas in converted into pressure increase and improvement of the turbine efficiency.

Apart from the gas turbine applications there are many other fields wherein the proposed compression tubes are very advantageous. They are preferred especially when low pressure hot gaseous media flow (with temperature exceeding 200° C.), because in this case the physical heat of the gaseous medium can be converted into pressure increase directly, without specific compressing means. The proposed compression tubes, as mentioned, are especially capable of applying waste heat, e.g. in pipeline systems transporting gas or oil, in the turbocharging devices of the internal combustion engines etc.).

The compression tube of the invention is a simple tool to accomplish continuous or pulsed gas transport from a lower pressure space to a greater pressure space exclusively by heat processes.

What we claim is:

1. A method of increasing pressure of a flowing gaseous medium, comprising the steps of accelerating the flow of a gaseous medium to a supersonic velocity range, abstracting heat from said gaseous medium while said medium is flowing in said supersonic velocity range, thereafter impacting the supersonically flowing gaseous medium into a space filled with said gaseous medium and creating thereby shock waves in said gaseous medium, and decelerating said supersonically flowing gaseous medium to a subsonic velocity range by conducting said flow through said shock waves for increasing the stagnation pressure of said gaseous medium.

2. The method as set forth in claim 1, comprising the further step of conducting the subsonically flowing gaseous medium into a tube section for further diminishing its velocity and increasing its stagnation pressure.

3. The method as set forth in claim 2, comprising the step of abstracting heat from said subsonically flowing gaseous medium being conducted through said tube section.

4. The method as set forth in claim 2, comprising the step of conducting the subsonically flowing gaseous medium into a diffuser.

5. The method as set forth in claim 1, comprising the step of conducting the supersonically flowing gaseous medium through a supersonic diffuser section during said abstracting step.

6. The method as set forth in claim 1, wherein said accelerating step ensures supersonic flow characterized by Mach number in the range 1.2 to 1.5.

7. The method as set forth in claim 1, comprising the step of maintaining adiabatic conditions during said accelerating step.

8. The method as set forth in claim 2, comprising the further step of introducing heat into said gaseous medium leaving said tube section in order to increase the temperature of said gaseous medium to a predetermined value range, said introducing step being carried out in isobaric conditions.

9. The method as set forth in claim 1, comprising the step of injecting a fluid medium into said supersonic flow of said gaseous medium for abstracting heat therefrom, said fluid medium being capable of abstracting heat in an endothermic physical reaction or chemical reaction.

10. The method as set forth in claim 1, comprising the step of injecting water into said supersonic flow for vaporizing in said abstracting step.

11. The method as set forth in claim 1, comprising the step of injecting gaseous substance into said supersonic flow in said abstracting step for dissociating said gaseous substance.

12. The method as set forth in claim 1, wherein the gaseous medium consists of free charge ions and an additional step of creating a magnetic field along the path of said flow is carried out.

13. A compression tube for increasing the stagnation pressure of a flowing gaseous medium in a power machine, comprising in an arrangement along a path of flow of a gaseous medium, including an accelerating element for increasing the velocity of flow of said gaseous medium to a supersonic range, a transient tube section for abstracting heat from said gaseous medium while said medium is flowing in said supersonic range, and an impact tube section for receiving shock waves generated in the supersonically flowing gaseous medium, said shock waves being generated by output pressure of said impact tube section for decelerating said supersonically flowing medium to a subsonic velocity range.

14. The compression tube as set forth in claim 13, wherein said impact tube section consists of a straight line input part and a subsonic diffuser for further increasing pressure of said gaseous medium and diminishing said velocity of flow by abstracting further heat from said gaseous medium.

15. The compression tube as set forth in claim 13, wherein said impact tube is connected with an output tube section connected to a heat source for increasing temperature of said gaseous medium.

16. The compression tube as set forth in claim 13, wherein said accelerating element is connected with an input tube section for heating up said gaseous medium before acceleration thereof.

17. The compression tube as set forth in claim 13, comprising injecting means for introducing fluid medium into the inner space of said transient tube section for abstracting heat from said gaseous medium during its supersonic velocity flow.

18. The compression tube as set forth in claim 13, wherein said accelerating element consists of a Laval nozzle.

19. The compression tube as set forth in claim 13, wherein said accelerating element is equipped with a heat isolating mantle.

20. A power machine, comprising an inlet section for inducing flow of a gaseous medium, a compressor for increasing pressure of said gaseous medium, power transformation means for producing mechanical work by making use of said gaseous medium, and exhaust means, said inlet section, compressor, power transformation means and exhaust means being connected by pipeline sections, wherein at least one pipeline section comprises a compression tube including in a linear arrangement along the path of said flow of said gaseous medium an accelerating element for increasing velocity of said flow of said gaseous medium to a supersonic velocity range, a transient tube section for abstracting heat from said gaseous medium while said gaseous medium is flowing in said supersonic velocity range, and an impact tube section for receiving shock waves being generated by output pressure of said impact tube section for decelerating the supersonically flowing gaseous medium to a subsonic velocity range.

21. The power machine as set forth in claim 20, wherein said impact tube section consists of a straight line input tube part and a subsonic diffuser part for further increasing pressure of said gaseous medium and diminishing said velocity of flow.

22. The power machine as set forth in claim 20, wherein said impact tube is arranged for abstracting heat from the subsonically flowing gaseous medium.

23. The power machine as set forth in claim 20, wherein said impact tube is connected with an output tube section connected with a heat source for increasing the temperature of said gaseous medium.

24. The power machine as set forth in claim 20, comprising one of said pipeline sections before the inlet of said compression tube an input tube section for heating up said gaseous medium before entering said compression tube and accelerating.

25. The power machine as set forth in claim 20, comprising injecting means arranged in one of said pipeline sections for introducing fluid medium into the inner space of said transient tube section for abstracting heat from said gaseous medium during its supersonic velocity flow.

26. The power machine as set forth in claim 20, wherein said accelerating element is a Laval nozzle.

27. The power machine as set forth in claim 20, wherein said accelerating element is equipped with a heat insulating mantle for creating adiabatic conditions during accelerating.

28. A power machine, comprising an inlet section for inducing flow of a gaseous medium, a compressor for increasing pressure of said gaseous medium, power transformation means for producing mechanical work by making use of said gaseous medium and exhaust means, said, inlet section, compressor, power transformation means and exhaust means being divided and connected by pipeline sections, wherein from among said pipeline section at least that connecting said power transformation means with said exhaust means includes a compression tube including in a linear arrangement along the path of said flow of said gaseous medium an accelerating element for increasing velocity of said flow of said gaseous medium to a supersonic velocity range, a transient tube section for abstracting heat from said gaseous medium while said medium is flowing in said supersonic velocity range, and an impact tube section for receiving shock waves being generated by output pressure of said impact tube section for decelerating said gaseous medium to a subsonic velocity range.

29. The power machine as set forth in claim 28, wherein said compressor is formed by said compression tube.

30. The power machine as set forth in claim 28, wherein said impact tube section consists of a straight line input tube part and a subsonic diffuser part for further increasing pressure of said gaseous medium and diminishing said velocity of flow.

31. The power machine as set forth in claim 28, wherein said impact tube is arranged for abstracting heat from the subsonically flowing gaseous medium.

32. The power machine as set forth in claim 28, wherein said impact tube is connected with an output tube section connected with a heat source for increasing temperature of said gaseous medium.

33. The power machine as set forth in claim 28, comprising in a pipeline section before the inlet of said compression tube an input tube section for heating up said gaseous medium before entering said compression tube and accelerating.

34. The power machine as set forth in claim 28, comprising injecting means arranged in said pipeline section for introducing fluid medium into the inner space of said transient tube section for abstracting heat from said gaseous medium during its supersonic velocity flow.

35. The power machine as set forth in claim 28, wherein said accelerating element consists of a Laval nozzle.

36. The power machine as set forth in claim 28, wherein said accelerating element is equipped with a heat insulating mantle for creating adiabatic conditions during accelerating.

* * * * *